United States Patent [19]

Holland-Letz

[11] 4,409,892

[45] Oct. 18, 1983

[54] HAND LABELLING APPARATUS

[75] Inventor: Günter Holland-Letz, Hirschhorn, Fed. Rep. of Germany

[73] Assignee: Esselte Pendaflex Corp., New York, NY

[21] Appl. No.: 284,204

[22] Filed: Jul. 17, 1981

[30] Foreign Application Priority Data

Aug. 8, 1980 [DE] Fed. Rep. of Germany ..... 3030139

[51] Int. Cl.[3] ..... B41J 5/00

[52] U.S. Cl. ..... 101/93.18; 101/92; 101/93.24; 101/93.25

[58] Field of Search ..... 101/92, 93.18, 93.24, 101/93.25, 110, 288, 291, 292; 156/384, 577, 579, DIG. 48, DIG. 49; 403/98, 154, 349

[56] References Cited

U.S. PATENT DOCUMENTS 3,880,546 4/1975 Segal ..... 403/349

4,149,460 4/1979 Sato ..... 101/110

*Primary Examiner*—Edgar S. Burr

*Assistant Examiner*—Bradley M. Lewis

*Attorney, Agent, or Firm*—Gerald J. Ferguson, Jr.; Joseph J. Baker

[57] ABSTRACT

A hand labeller having a plurality of rotatable print wheels with selectable print types disposed on the periphery of each print wheel and a selector spindle for positioning selected print types at a printing zone of the print wheels. The selector spindle includes a reduced diameter portion which engages and slides in an arcuate slot in the labeller housing if (a) the spindle is fully pushed into the print wheels and (b) the labeller is operated to rotate the print zone of the print wheels to a label printing position. If the spindle is not fully pushed in, a large diameter portion of the spindle will engage the arcuate slot, the latter portion being too large to enter the slot whereby the print zone of the print wheels is inhibited from rotation to the label printing position.

1 Claim, 3 Drawing Figures

HAND LABELLING APPARATUS

BACKGROUND AND SUMMARY OF THE INVENTION

The present invention relates to a hand labelling apparatus for imprinting and dispensing pressure-sensitive labels, comprising a housing, a print wheel which is mounted rotatably about an axis between a rest position and an operating position and on the peripheral surface of which print types are disposed in a plurality of planes adjacent each other in the axial direction, and an adjusting spindle extending parallel to said axis and connected to the print wheel, said spindle being displaceable at a side face of the print wheel between a pushed-in position and a withdrawn position and projecting outwardly through a housing wall, and with the aid of said spindle the print types disposed in the various planes are adjustable relatively to each other in such a manner that desired print types move into a printing zone at the peripheral surface of the print wheel.

Such a hand labelling apparatus is already known from U.S. Pat. No. 3,330,207. In this hand labelling apparatus the setting or adjusting spindle, with which desired print types on the print wheel can be brought into a print position, projects from the housing side wall. When carrying out an adjusting operation the adjusting spindle must be withdrawn to a greater or lesser extent depending on which digit of the imprint to be produced with the aid of the print wheel is to be changed. If after making the change the operator forgets to return the adjusting spindle to the pushed-in position there is a danger of the adjusting spindle being damaged by knocks or even breaking off. However, even if the damage is not so severe an impact on the adjusting spindle can impair the relatively complicated adjusting mechanism within the print wheel as regards its function.

The objective of the present invention is to provide a hand labelling apparatus of the type mentioned at the beginning such that there is no danger of damage to the adjusting spindle of the print wheel in operation of the apparatus.

According to the invention this objective is achieved in that the diameter of the adjusting spindle is reduced in the region which lies in the plane of the housing wall when the adjusting spindle is completely retracted, that in the housing wall at the location in which the adjusting spindle is disposed in the rest position of the print wheel an opening is provided whose internal width is greater than the non-reduced diameter of the adjusting spindle, and that adjoining the opening in the housing wall there is a slot whose path corresponds to the path which the adjusting spindle describes on rotation of the print wheel from the rest position to the operating position and whose internal width lies between the reduced and the non-reduced diameters of the adjusting spindle.

In the hand labelling apparatus according to the invention the print wheel can rotate from the operating position to the rest position only when the adjusting spindle is completely retracted. This is achieved by the particular configuration of the adjusting spindle and the opening with the adjoining slot in the housing wall. In the rest position of the print wheel the adjusting spindle projects outwardly through the opening in the housing wall and can be displaced between the retracted and withdrawn position because the internal width of the opening is greater than the non-reduced diameter of the adjusting spindle. However, rotation of the print wheel with the adjusting spindle withdrawn is not possible because the slot adjoining the opening has an internal width which is smaller than the non-reduced diameter of the adjusting spindle. Only when the adjusting spindle is completely pushed-in can the print wheel rotate from the rest position to the operating position because in this case the region of the adjusting spindle with reduced diameter lies in the plane of the housing wall and on rotation of the print wheel enters the slot. This particular configuration compels the operator after conducting a change of the label imprint to be produced with the print wheel always to bring the adjusting spindle again completely into the retracted position because otherwise actuation of the apparatus, in which rotation of the print wheel occurs, is not possible. This eliminates the danger of damage when the spindle projects.

DETAILED DESCRIPTION OF THE INVENTION

Figure 1:
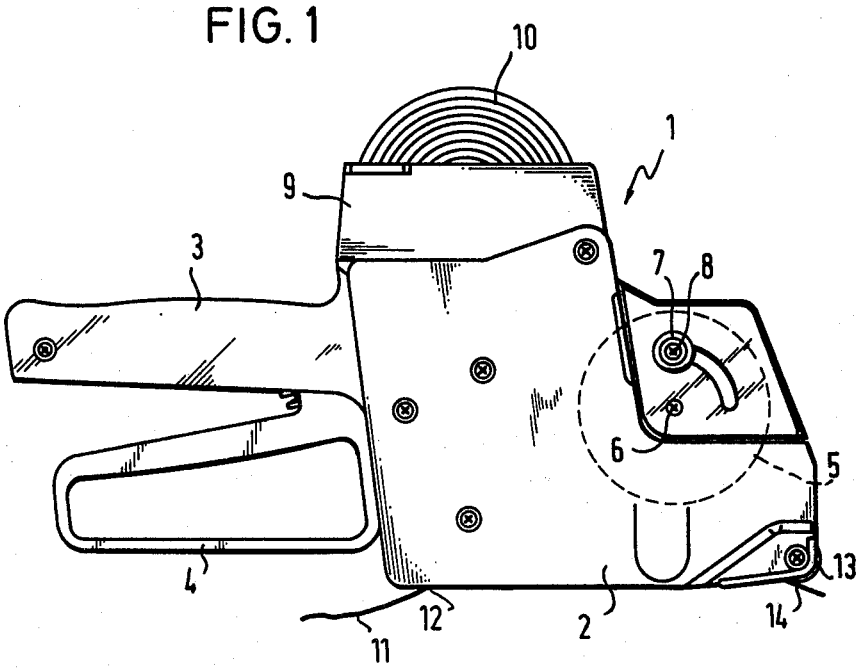
FIG. 1 is a side view of a hand labelling apparatus according to the present invention.

In FIG. 1 a hand labelling apparatus 1 is illustrated with the aid of which pressure-sensitive labels can be imprinted in the course of an operating cycle and dispensed. The hand labelling apparatus 1 includes a housing 2 with a grip 3. Disposed beneath the grip 3 is an operating lever 4 which can be squeezed against said grip 3. On squeezing of the operating lever 4 against the grip 3 and subsequent automatic return to the starting position illustrated in FIG. 1 the hand labelling apparatus 1 performs one complete operating cycle.

In the front portion of the housing 2 a print wheel 5 is disposed which is indicated in dashed line and rotatably mounted about a shaft 6. By means of an adjusting spindle 8 provided with a rotary knob 7 print types disposed at the peripheral surface of the print wheel 5 can be brought into a predetermined printing zone at the print wheel periphery. Further details of the print wheel 5 and the associated setting or adjusting spindle 8 will be explained in connection with FIGS. 2 and 3.

Disposed at the top of the hand labelling apparatus 1 is a well 9 which serves to accommodate a supply roll 10 of a carrier tape 11 provided with pressure-sensitive labels. In the operating condition the carrier tape 11 with the pressure-sensitive labels adhering thereto extends from the supply roll 10 disposed in the well 9 downwardly and then tangentially past the print wheel 5 to a peel edge disposed near the front end of the bottom of the apparatus 1 and at said edge the carrier tape is deflected through an angle of almost 180° and then led rearwardly to a dispensing point 12. Because of the deflection of the carrier tape 11 at the peel edge the pressure-sensitive labels are detached so that they move into a dispensing position beneath an applicator roll 13 and can be applied to an article. In FIG. 1 a pressure-sensitive label 14 is disposed in the dispensing position beneath the applicator roll 13 is shown. In the course of an operating cycle one pressure-sensitive label is imprinted and brought into the dispensing position beneath the applicator roll 13.

Figure 2:
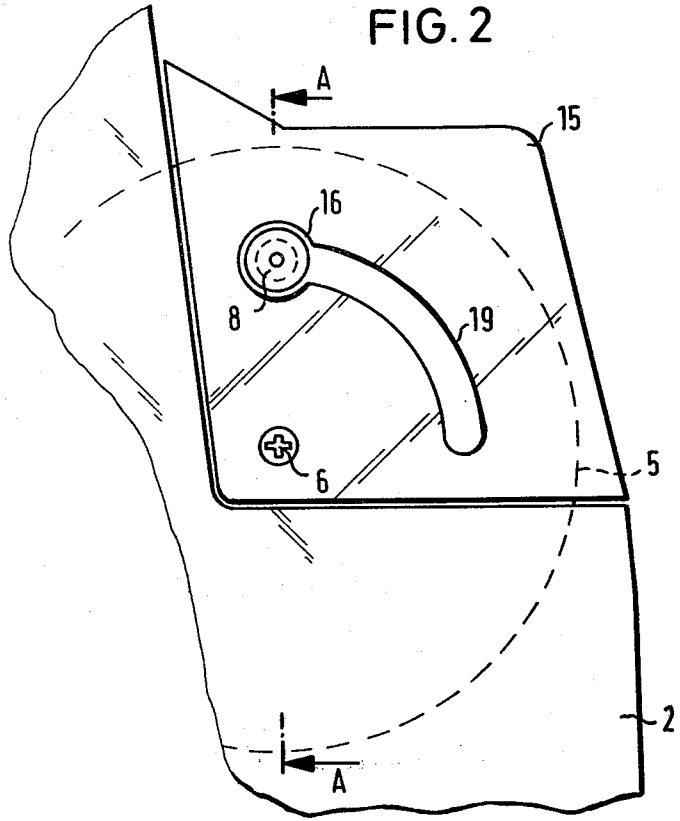
FIG. 2 is a schematic fragmental view of the hand labelling apparatus of FIG. 1

FIG. 2 shows to a larger scale diagrammatically the part of the hand labelling apparatus containing the print wheel 5 and lying in the upper half of the front section in FIG. 1. The knob 7 is omitted in order to illustrate the adjusting spindle 8 more clearly. As apparent from FIG. 2 in the side wall 15 of the housing 2 an opening 16 is disposed through which the adjusting spindle 8 can be pulled out of the housing in the direction of the axis of said spindle and again pushed in to said housing.

Figure 3:
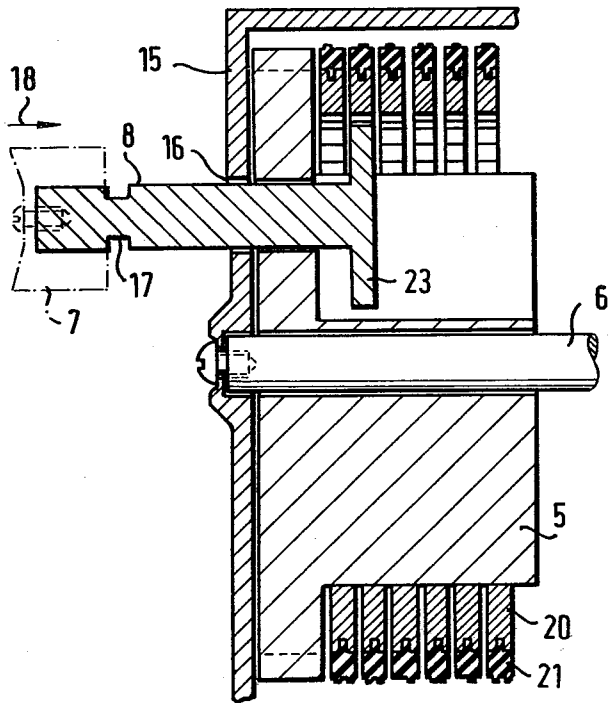
FIG. 3 is a section along the line A—A of FIG. 2.

According to FIG. 3 the adjusting spindle 8 comprises a region 17 of reduced diameter which when the adjusting spindle is completely retracted in the direction of the arrow 18 lies in the plane of the housing wall 15. As apparent from FIGS. 2 and 3 the internal width of the opening 16 is somewhat greater than the non-reduced diameter of the adjusting spindle 8.

According to FIG. 2 the opening 16 is adjoined by a slot 19 which extends in a concentric arc about the axis 6 of the print wheel and the internal width of which lies between the reduced diameter of the region 17 and the non-reduced diameter of the adjusting spindle 8.

Withdrawing of the adjusting spindle 8 is necessary when the imprint to be produced on a pressure-sensitive label is to be changed with the aid of the print wheel 5. According to FIG. 3 the print wheel 5 includes a plurality of type rings 20 on the peripheral surface of which print types 21 are disposed. The print types are adjacent each other in the axial direction and behind each other in the peripheral direction on the individual print rings. With the aid of the adjusting spindle 8 carrying a pinion 23 at its end lying within the print wheel 5 the type rings 20 can be rotated relatively to each other so that desired print types 21 come into a predetermined printing zone at the periphery of the print wheel 5. To carry out a setting operation the adjusting spindle 8 is withdrawn from the housing until the pinion 23 lies in a plane with the type ring 20 to be adjusted. By means of the knob 7 the pinion 23 can then be rotated via the adjusting spindle until the desired print type 21 lies in the printing zone. In this manner, by pulling out the adjusting spindle 8 to various degrees all the type rings can be adjusted as desired.

After carrying out a setting operation the adjusting spindle 8 may project considerably from the side wall 15 as for example in FIG. 3. If the hand labelling apparatus 1 is used with the adjusting spindle 8 in this position there is a danger of said spindle being damaged by a knock or impact transverse to its axis. To eliminate this danger for the spindle 8 because of the specific dimensioning of the internal width of the slot 19 it is not possible to carry out an operating cycle whilst the adjusting spindle is withdrawn from the housing. In the withdrawn condition, in the plane of the side wall 15 there is a region of the adjusting spindle 8 whose diameter is not reduced; although this region can pass unrestricted through the opening 16 it cannot enter the slot 19 on rotation of the print wheel 5. Only when the adjusting spindle 8 has been completely pushed into the housing in the direction of the arrow 18 does the region 17 of reduced diameter come to lie in the plane of the side wall 15 so that the adjusting spindle 8 can then be rotated together with the print wheel 5 unrestricted in the view of FIG. 2 in the clockwise direction about the axis 6. Since in the hand labelling apparatus 1 described the print wheel during an operating cycle rotates from the rest position of FIGS. 1 and 2 through about 90° in the clockwise direction and then back into the initial position, the slot also extends through an angle of about 90°.

With the aid of the features described the addjusting spindle 8, after carrying out a change of the imprint to be produced by means of the print wheel 5, is brought in every case firstly again into the completely pushed-in position before the hand labelling apparatus 1 can be reactuated to carry out a new operating cycle.

What we claim is:

1. A hand labelling apparatus for rolling imprinting and for dispensing pressure-sensitive labels, comprising a housing having at least one wall, a print wheel mounted rotatably about an axis for movement between a rest position and an operating position and on the peripheral surface of which print types are disposed in a plurality of planes adjacent each other in the axial direction of said print wheels, means to position selected ones of said print types from each of said planes in a printing zone which extends parallel to said axis at the peripheral surface of the print wheel where, upon movement of the print wheel to the operating position, the selected print types engage at least one of said pressure-sensitive labels in rolling contact in response to the print wheel being rotated from its rest position to its operated position to thus print said at least one label with the selected print types by rolling movement of said selected print types across said labels, and an adjusting spindle extending parallel to said axis and connected to the print wheel, said spindle being displaceable in a direction parallel to said axis between a pushed-in position and a pulled-out position and projecting outwardly through an opening in said housing wall, said spindle including means selectively engageable with the print types disposed in each of the various planes to move the print types in each plane relative to the print types in the remaining planes so that the selected print types are positioned in said printing zone at the preipheral surface of the print wheel, means to permit movement of said print wheel from said rest position toward said operating position only when said spindle is fully in its pushed-in position, said means including a reduced diameter region of the addjusting spindle, said reduced region being the region which lies in the plane of the housing wall when the adjusting spindle is completely pushed in, said opening in the housing wall through which said adjusting spindle passes when the print wheel is in the rest position having an internal diameter greater than the non-reduced diameter of the adjusting spindle, and an arcuate slot whose path intersects said opening and corresponds to the path which the adjusting spindle describes on on rotation of the print wheel from the rest position to the operating position, the internal width of said slot being greater than the reduced diameter of said spindle and less than the non-reduced diameter of said adjusting spindle, whereby said spindle can enter said arcuate slot only when said spindle is in its fully pushed-in position and said print wheel is prevented from moving from its rest position when said spindle is not in its fully pushed-in position by the non-reduced diameter of said spindle which cannot leave said opening and enter said arcuate slot.

* * * * *